US008505724B2

(12) United States Patent
Bult et al.

(10) Patent No.: US 8,505,724 B2
(45) Date of Patent: Aug. 13, 2013

(54) PACKAGE ASSEMBLY FOR WIPER BLADE

(75) Inventors: David H. Bult, Jenison, MI (US); George E. Raimer, Saranac, MI (US); Matthew D. Hansen, Rockford, MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

(21) Appl. No.: 13/585,922

(22) Filed: Aug. 15, 2012

(65) Prior Publication Data

US 2013/0105343 A1 May 2, 2013

Related U.S. Application Data

(63) Continuation-in-part of application No. 29/405,527, filed on Nov. 3, 2011, and a continuation-in-part of application No. 29/404,835, filed on Oct. 26, 2011.

(51) Int. Cl.
*B65D 85/48* (2006.01)

(52) U.S. Cl.
USPC ..... 206/448; 206/470; 206/483

(58) Field of Classification Search
USPC ..... 206/349, 443, 446, 335, 448, 461, 206/467, 470, 471, 477, 478, 483
See application file for complete search history.

(56) References Cited

U.S. PATENT DOCUMENTS

| | | | | |
|---|---|---|---|---|
| 6,041,933 | A * | 3/2000 | Baker | 206/564 |
| D540,163 | S | 4/2007 | Claussen | |
| 7,328,803 | B2 * | 2/2008 | Yamazaki et al. | 206/588 |
| 7,337,900 | B2 * | 3/2008 | Reiber et al. | 206/349 |
| 7,926,659 | B2 * | 4/2011 | Kim | 206/471 |
| 2005/0252812 | A1 * | 11/2005 | Lewis | 206/461 |
| 2010/0307940 | A1 * | 12/2010 | Kim | 206/349 |

* cited by examiner

*Primary Examiner* — Jacob K Ackun
(74) *Attorney, Agent, or Firm* — Warner Norcross & Judd LLP

(57) ABSTRACT

A wiper package assembly for use in packaging a pre-curved wiper blade. The wiper package assembly generally includes a package and a pair of end caps fittable onto the wiper blade and into the package. The package and end caps may be configured to cooperatively hold the pre-curved wiper blade in an at least partially straightened condition. The end caps may be configured to engage the wiper blade without altering the shape of the wiper blade tip, thereby reducing the risk of the wiper tip becoming deformed during by the package. In one embodiment, the end caps are ambidextrous in the sense that identical end caps can be used on opposite ends of the wiper blade. The end cap may include two support slots configured to correspond with the shape of the opposite ends of an asymmetrical wiper blade.

25 Claims, 8 Drawing Sheets

PACKAGE ASSEMBLY FOR WIPER BLADE

BACKGROUND OF THE INVENTION

The present invention relates to packaging and more particularly to packages for windshield wiper blades.

Windshield wiper systems are used on a variety of vehicles. Although windshield wiper systems are available in different styles, a typical windshield wiper system includes replaceable wiper blades that can be removed and replaced as desired. Replacement wiper blades are often purchased individually from any one of a wide variety of retailers. Replacement wipers are typically sold in packages that are specially configured to meet the specific demands of packaging wiper blades.

A typical windshield wiper blade includes a support element that carries a flexible wiper. The support element is configured to be removably mounted to the windshield wiper arm of the vehicle. The flexible wiper includes a tip configured to engage a windshield. Generally speaking, it is important for the tip to uniformly and consistently engage the window during use. Because windshields are typically curved, special consideration must be taken in designing wiper blades. A variety of alternative wiper blade designs have been developed to improve interaction between the wiper blade and the windshield.

With one type of wiper blade, the support element includes an arrangement of articulating arms configured to hold the wiper at different points along its length. The arms are pivotally interconnected so that they can articulate with respect to one another to allow the wiper to adapt to the shape of the windshield. In this type of wiper blade, pressure from the windshield wiper arm pushes the wiper blade against windshield. As a result of the pivoting arms, the wiper blade is able to conform to the curved shape of the window. With another type of blade, the support element is a curved element shaped to provide the wiper with the desired curve. This second type of wiper blade is commonly referred to as a beam-type blade or a "beam blade." In a beam blade, the curved shape of the support element urges the wiper against the window along its length.

As noted above, wiper blades present a number of challenges with respect to packaging. Generally, it is important for the flexible tip to retain its manufactured shape or the performance of the wiper blade may suffer. Although highly resilient, wiper blades are typically manufactured from materials that can retain some deformation when held in a deformed condition for an extended period of time. For example, extended contact between the tip and the package can result in bends, ripples or other deformations in the tip. The bends or ripples can negatively impact performance of the wiper blade. As a result, it is desirable for wiper blade packaging to support the wiper blade without causing any deformation in the wiper tip. Further, conventional beam-type wiper blades are manufactured with a gradual longitudinal curve intended to provide improved performance. The presence of this curve in the wiper blade increases the size of the wiper (as compared to a straight blade) and presents further difficulties in designing packaging for the wiper blade.

A variety of conventional packages are available for use in packaging pre-curved wiper blades. A number of these packages are configured to reduce the overall width of the package by holding the pre-curved wiper blade in a somewhat straightened configuration. Although existing packages are capable of retaining a pre-curved wiper blade in an at least partially straightened state, they require a relatively large amount of plastic and are therefore relatively costly to manufacture.

Further, some require relatively complicated action to package the wiper blade in a straightened state and can therefore increase the cost of packaging.

To accommodate different windshields, wiper blades are available in a variety of sizes and shapes. The need for packaging to accommodate wiper blades of different sizes and shapes only increases the difficulty in designing wiper blade packaging. With some types of packaging, a variety of different packages must be provided to accommodate different wiper blades.

SUMMARY OF THE INVENTION

The present invention provides a wiper package assembly for use in packaging a pre-curved wiper blade. The wiper package assembly generally includes a package and a pair of end caps capable of being fitted onto the wiper blade and into the package. The package may include first and second parts that are joined along a hinge and can be closed to define space for containing the wiper blade with fitted end caps. The end caps may be configured to be fitted onto opposite ends of the pre-curved wiper blade and to interact with the package to remove at least a portion of the pre-curve from the wiper blade. The end caps may be configured to engage the wiper blade without altering the shape of the tip, thereby reducing the risk of the wiper tip becoming deformed during by the package.

In one embodiment, the end caps are configured to be slid over opposite ends of the wiper blade. The end caps may be closed on one end and may have a flange on the other. The flange may be configured to be closely received within the interior of the package.

In one embodiment, the end caps are configured to be snap-fitted onto the wiper blade. The end caps may include protrusions configured to frictionally interfit with contours in the wiper blade.

In one embodiment, the end caps may define a support slot configured to receive the support element of the wiper blade and a tip slot configured to receive the tip of the wiper blade. The support slot may be shaped to tightly receive the support element so that the wiper blade is somewhat straightened by interaction of the end caps with the support element when the end caps are fitted within the package. The tip slot is shaped to receive the tip of the wiper blade. The tip slot is shaped so that the tip is not deformed by the end cap when the wiper blade is packaged. In one embodiment, the tip slot is large enough that it does not contact the tip of the wiper blade when installed on either end.

In one embodiment, the end cap is ambidextrous in the sense that identical end caps can be used on opposite ends of the wiper blade. The end cap may include two support slots configured to correspond with the shape of the opposite ends of the wiper blade. Further, the flange of the end cap may be shaped so that it can be properly fitted into the package when positioned on either end of the wipe blade. Alternatively, the package assembly may include two different end caps configured to be fitted onto opposite ends of the wiper blade.

In one embodiment, the package includes a pair of locking tabs extending from the edge of one part of the package. The tabs may fold around and interlock with the other part of the package. The package may include two locking tabs spaced apart along the package. The tabs may be generally triangular in cross section and configured to be fitted into a complementary triangular void in the backside of the other part of the package.

The present invention provides a simple and effective package assembly that allows a pre-curved wiper blade to be contained in somewhat straightened state, thereby reducing the overall width of the wiper blade and consequently the package. The end caps allow the package assembly to shape the wiper blade without damaging the wiper tip. The end caps allow a package assembly that utilizes less plastic, and therefore is less costly to manufacture. The end caps are also easily installed on the wiper blade without the need to pre-straight the wiper blade, thereby facilitating packaging.

These and other features of the invention will be more fully understood and appreciated by reference to the description of the embodiments and the drawings.

Figure 1:
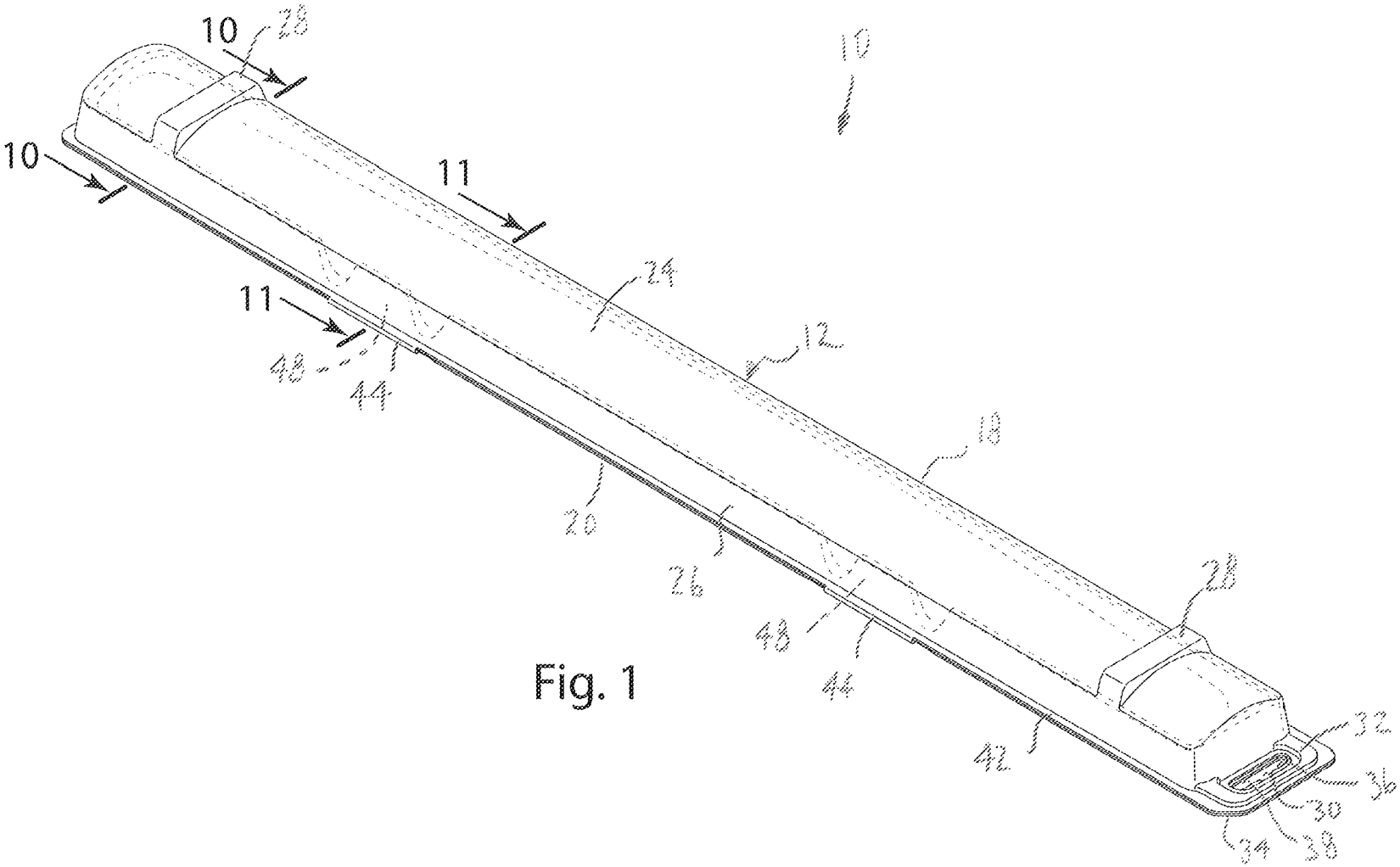
FIG. 1 is a perspective view of a wiper blade packaged in a package assembly in accordance with an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DESCRIPTION OF CURRENT EMBODIMENTS

Figure 2:
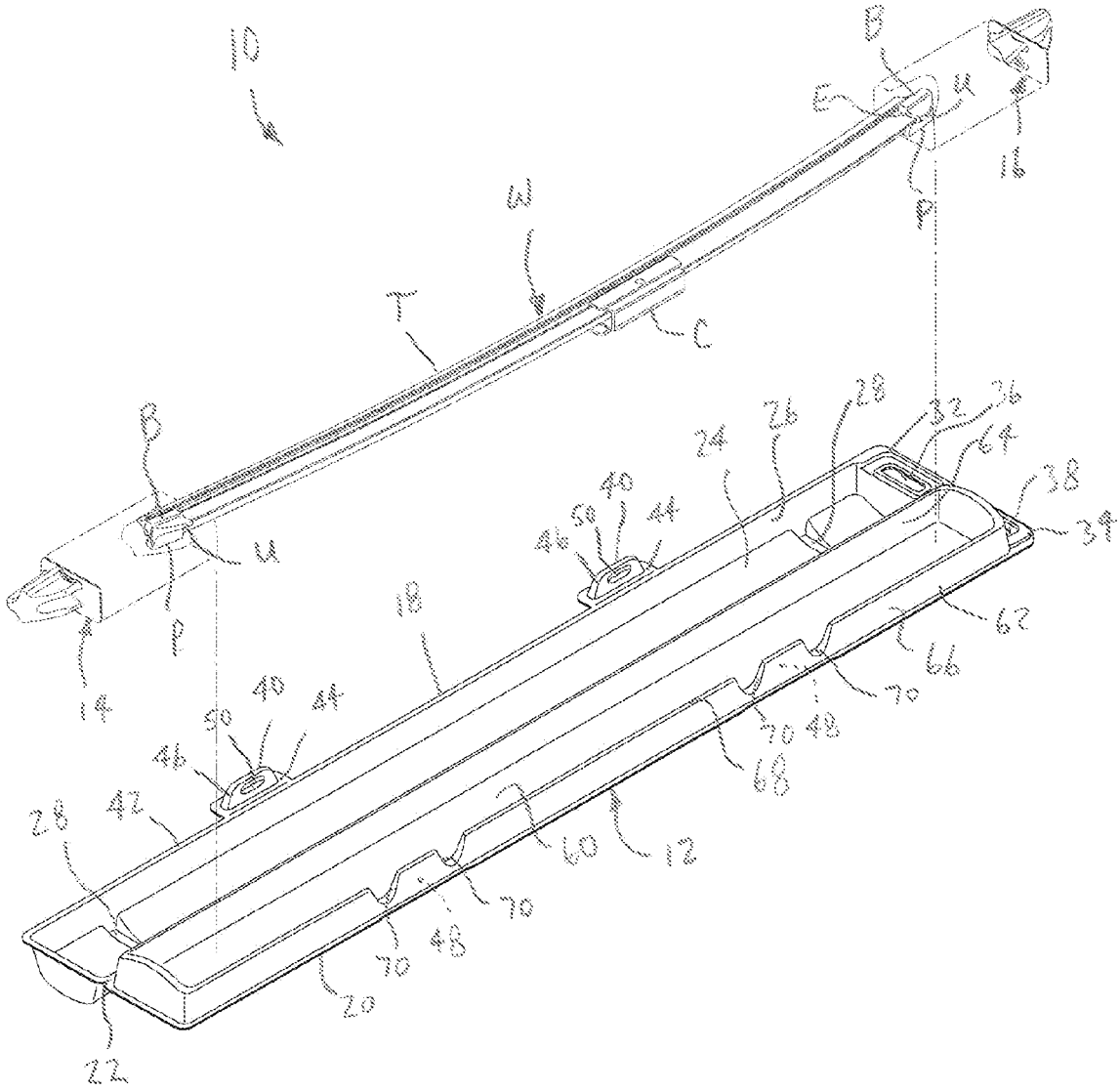
FIG. 2 is an exploded perspective view of the wiper blade and package assembly.

A replacement wiper blade W contained in a package assembly 10 in accordance with an embodiment of the present invention is shown in FIG. 1. As perhaps best shown in FIG. 2, the package assembly 10 generally includes a package 12 and a pair of end caps 14 and 16. The end caps 14 and 16 are configured to be fitted onto opposite ends of the wiper blade W and then fitted into package 12. In the embodiment of FIG. 1, the package 12 and end caps 14 and 16 are configured to remove some portion of the pre-curve from the wiper blade W when fitted into the package 12. The package 12 and end caps 14 and 16 are configured to hold the packaged wiper blade W without deforming the tip of the wiper blade.

The present invention is illustrated in connection with one particular replacement wiper blade. It should be understood that wiper blades vary in size, shape and configuration, and that the present invention is not limited to the wiper blade shown in the illustrations. For example, the end cap contours may vary from application to application to accommodate the wiper blade to be packaged. The present invention is well-suited for, but not limited to use in, packaging pre-curved wiper blades.

Directional terms, such as "front," "rear," "vertical," "horizontal," "top," "bottom," "upper," "lower," "inside," "inner," "inwardly," "outside," "outer" and "outwardly," are used to assist in describing the invention based on the orientation of the embodiments shown in the illustrations. The use of directional terms is merely an expedient to facilitate disclosure with reference to the illustrations and should not be interpreted to limit the invention to packages of any specific orientation(s).

Figure 4:
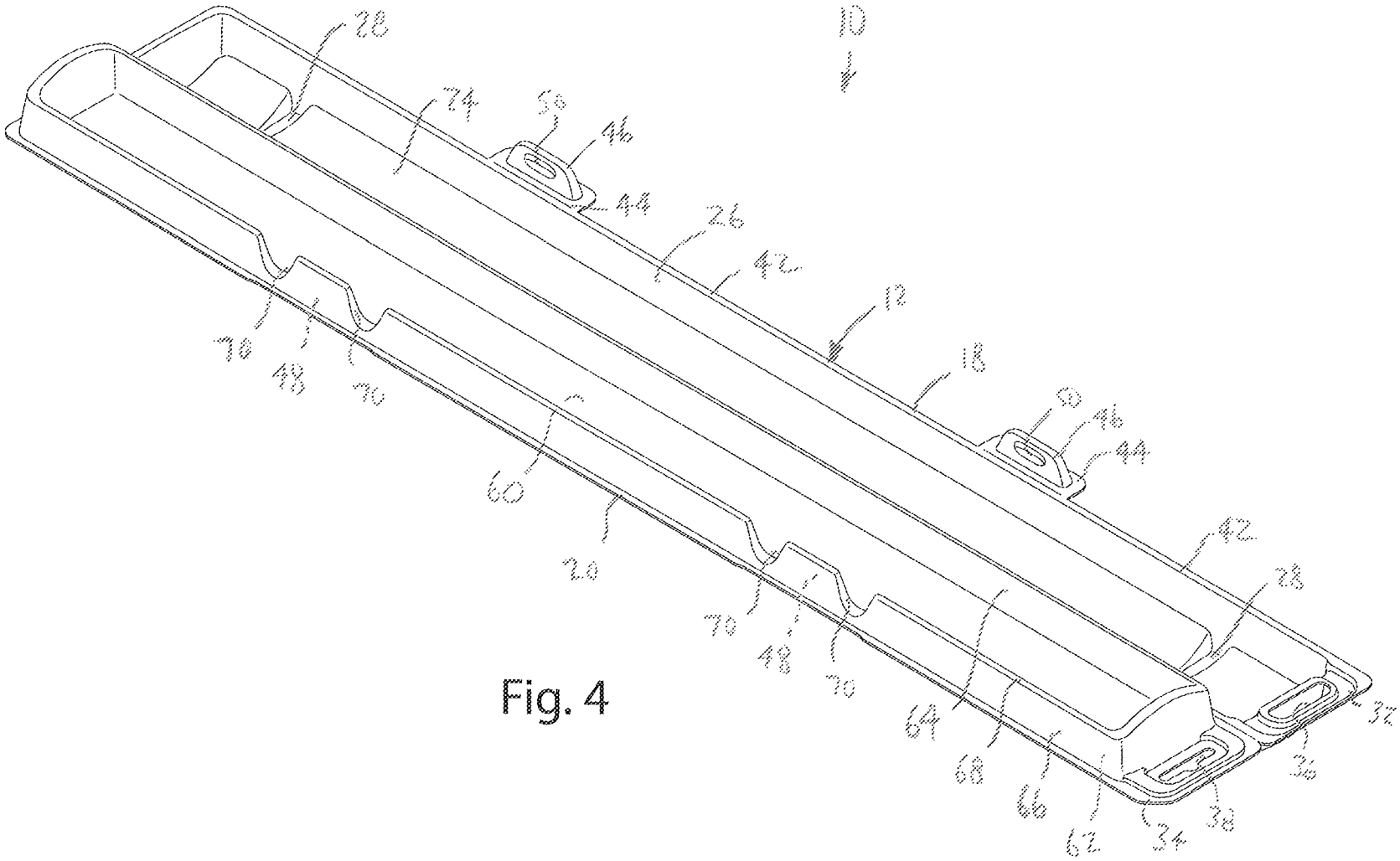
FIG. 4 is a perspective view of the package.

In the illustrated embodiment, the package is a clamshell package having a front part 18 and a rear part 20 joined along a hinge 22. The package 12 may alternatively be formed from two separate parts, for example, separate front and rear parts that are joined together during packaging or by a separate hinge element. Referring now to FIGS. 1 and 4, the front part 18 of the package 12 includes a face 24 surrounded by a peripheral wall 26. In this embodiment, the face 24 is curved in the lateral direction, primarily for design and aesthetic reasons. The size, shape and configuration of the face 24 may vary from application to application. The face 24 includes a pair of nesting elements 28. The nesting elements 28 extend from the face 24 and provide a generally flat surface to facilitate nesting of package assemblies 10. For example, a second package may be stacked on top of a first package, with the bottom of the second package resting on the flat upper surfaces of the nesting elements 28. In this embodiment, the peripheral wall 26 extends from the perimeter of the face 24 to define a skirt that is sized and shaped to be closely fitted over the rear part 20, as defined in more detail below. In this embodiment, the free edge of the peripheral wall 26 may be turned out to define a small flange 42 extending around the perimeter of the front part 18. The size, shape and configuration of the flange 42 may vary from application to application, as desired. In some applications, the flange 42 may be eliminated.

Figure 3:
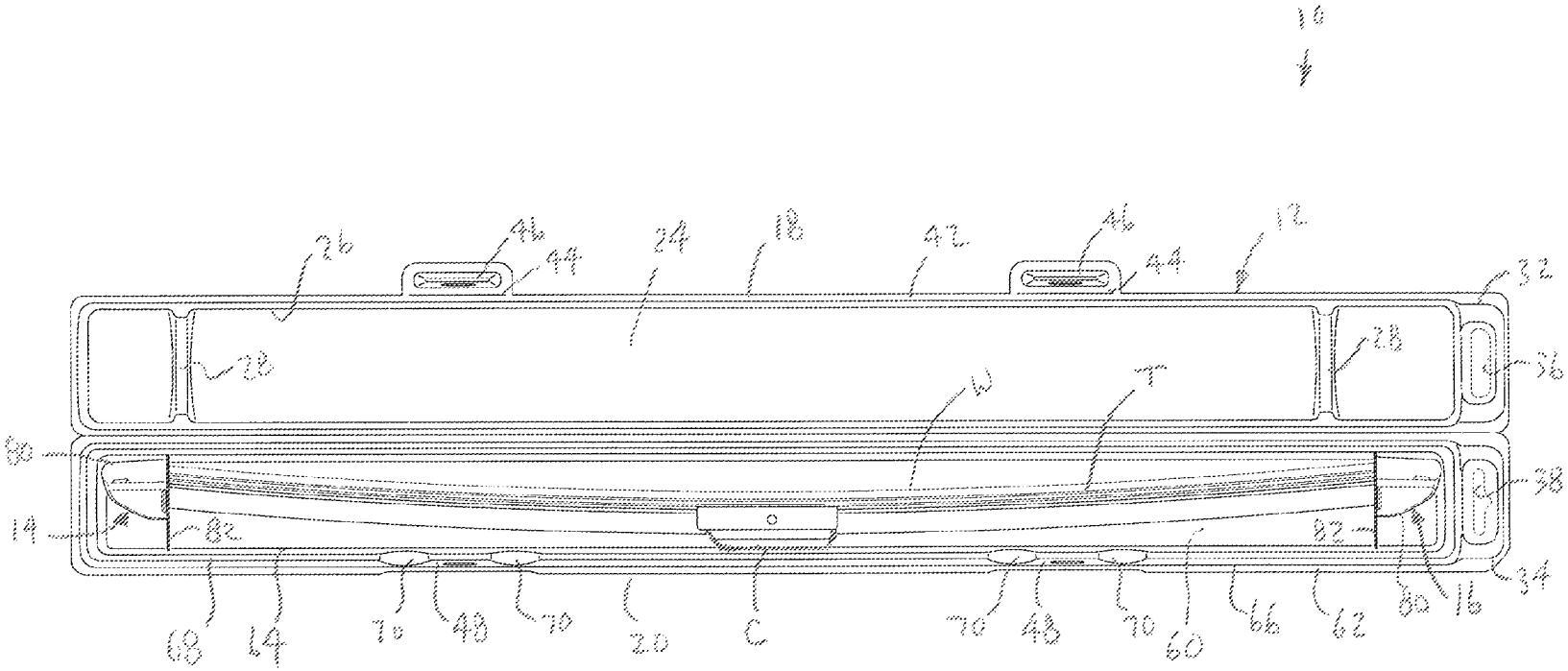
FIG. 3 is a top plan view of the wiper blade and package assembly with the package open showing the wiper blade and end caps within the package.
Figure 11:
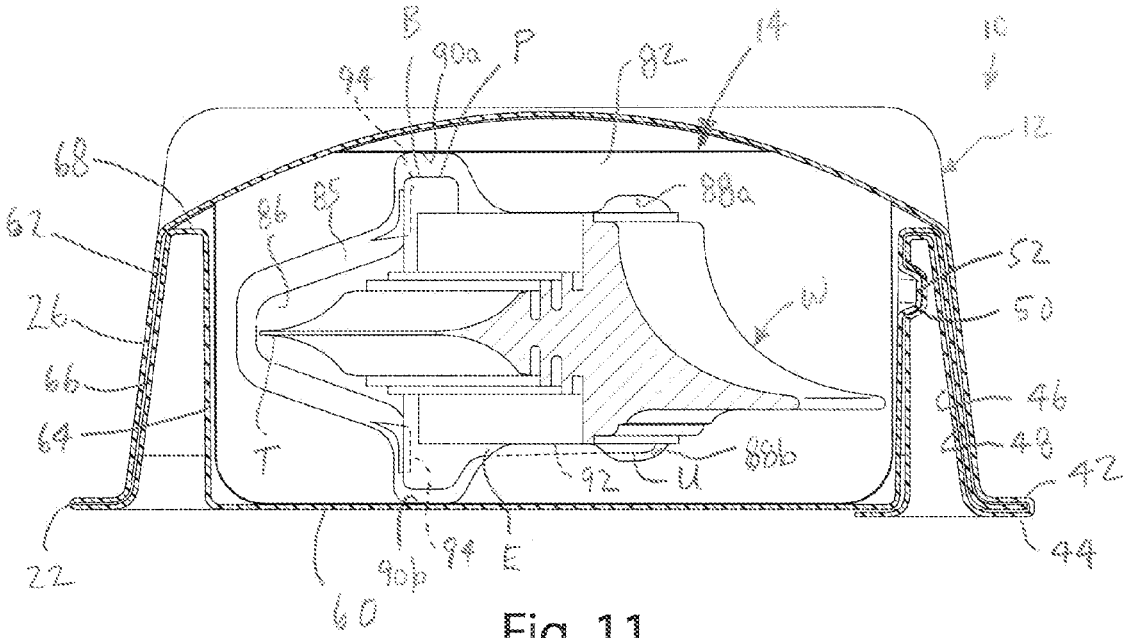
FIG. 11 is a sectional view of the closed package taken along line 11-11 of FIG. 1 showing the closed locking tabs.

In this embodiment, the package assembly 10 is configured to be locked in the closed position by locking elements 40. Although the number of the locking elements 40 may vary from application to application, the package assembly 10 includes two locking elements 40. Each locking elements 40 may include a tab 44 and a finger 46. In this embodiment, the tab 44 is configured to be folded around the back-side of the package assembly 10 so that the finger 46 can be fitted into a corresponding receptacle 48 in the rear part 20, as described in more detail below. As shown in FIG. 3, the tab 44 may be an extension of the flange 42. In this embodiment, the finger 46 is generally triangular in cross-section, tapering away from the tab 44. The size, shape and configuration of the finger 46 may, however, vary from application to application. The fingers 46 may be configured to snap-lock into position in the receptacles 48. In this embodiment, each finger 46 includes an indentation 50 in one major surface. Alternatively, each finger 46 may include indentations in opposite major surfaces. These indentations 50 are configured to be interfitted with corresponding protrusions 52 in the major surfaces of the receptacle 48. More specifically, and as perhaps best shown in FIG. 11, each finger 46 may be fitted upwardly into the corresponding receptacle 48 until indentation 50 and protrusion 52 become interlocked. The size, shape and configuration of the indentations 50 may be selected to help set the amount of force required to open and close the package 10. For example, the type of material used to form the package, the thickness of the material and/or the depth of the locking elements can be varied to tune the force required to open and close the package. As another example, the angles of the leading and trailing edges of the locking elements can be selected to separately tune the amount of force required to open or close the package. Although this embodiment includes protrusions 52 in the receptacle 48 and indentations 50 in the fingers 46, they may be reversed—protrusions on the fingers and indentations in the receptacle. Alternatively, the fingers and receptacles may include other features that allow them to interlock. For example, the fingers and receptacles may both include protrusions that interact when the package is opened and closed.

In the illustrated embodiment, the rear part 20 includes a back 60 and a peripheral wall 62 extending from the perimeter of the back 60. The peripheral wall 62 may be a double-wall having two wall segments 64 and 66. In this embodiment, the inner wall segment 64 extends from the back 60 and is joined to the outer wall segment 66 by an outer shoulder 68. A peripheral flange 58 may extend from the free edge of the outer wall segment 66. The inner wall segment 64 and the outer wall segment 66 may extend at an angle to one another following a generally triangular shape that corresponds with the shape of the fingers 46. As perhaps best shown in FIG. 4, the package assembly 10 of this embodiment includes two receptacles 48 formed within the peripheral wall 62. In this illustrated embodiment, inner and outer wall segments 64, 66 cooperatively define receptacles 48. The boundaries of each receptacle 48 may be defined by a pair of end contours 70. As can be seen, the end contours 70 cooperate with the inner and outer wall segments 64, 66 to define receptacles 48 that will closely interfit with the fingers 66. The end contours 70 not only assist in defining the receptacles 48, but also increase the strength of the peripheral wall 62 and consequently the package assembly 10. As noted above, each receptacle 48 may include a pair of protrusions 52 that extend into the receptacle 48 to interfit with indentations 50 in the fingers 46. As noted above, this particular interlocking arrangement is merely exemplary. The receptacles 48 and fingers 46 may include alternative contours to assist in interlocking the fingers 46 and receptacles 48.

In this embodiment, the package assembly 10 is intended to be hung from a display hook or other similar element. Accordingly, in this embodiment, the package assembly 10 includes a hang hole 30 defined at its upper end. In the package assembly 10 of FIG. 1, the hang hole 30 is cooperatively formed by the front part 18 and the rear part 20. More specifically, the front part 18 includes a front extension 32 and the rear part includes a rear extension 34. The front and rear extensions 32 and 34 come together when the package 12 is closed. The front extension 32 is contoured and defines a front central opening 36. The rear extension 34 is also contoured and defines a rear central opening 38. The contours of the front extension 32 and the rear extension 34 are configured in a complementary manner so that the contours of the front extension 32 and the rear extension 34 nest or interfit when the package 12 is closed. In this embodiment, the front central opening 36 is somewhat oval and of sufficient size to expose the rear central opening 38. The rear central opening 38 of this embodiment has a generally conventional hang-hole shape, which helps to center the package assembly 10 on the hanging hook.

In the illustrated embodiment, front part 18 and rear part 20 are joined together along a hinge 22. In this embodiment, front part 18, rear part 20 and hinge 22 are integrally formed as a single piece. As shown, the hinge 22 may be a living hinge, and it may be an extension of front flange 42 and rear flange 58. The hinge 22 may be defined by a contour or other feature in the material forming the package 12. For example, the hinge 22 may be defined by a crease, a cut score or one or more bends in the material forming the package 12.

Figure 5:
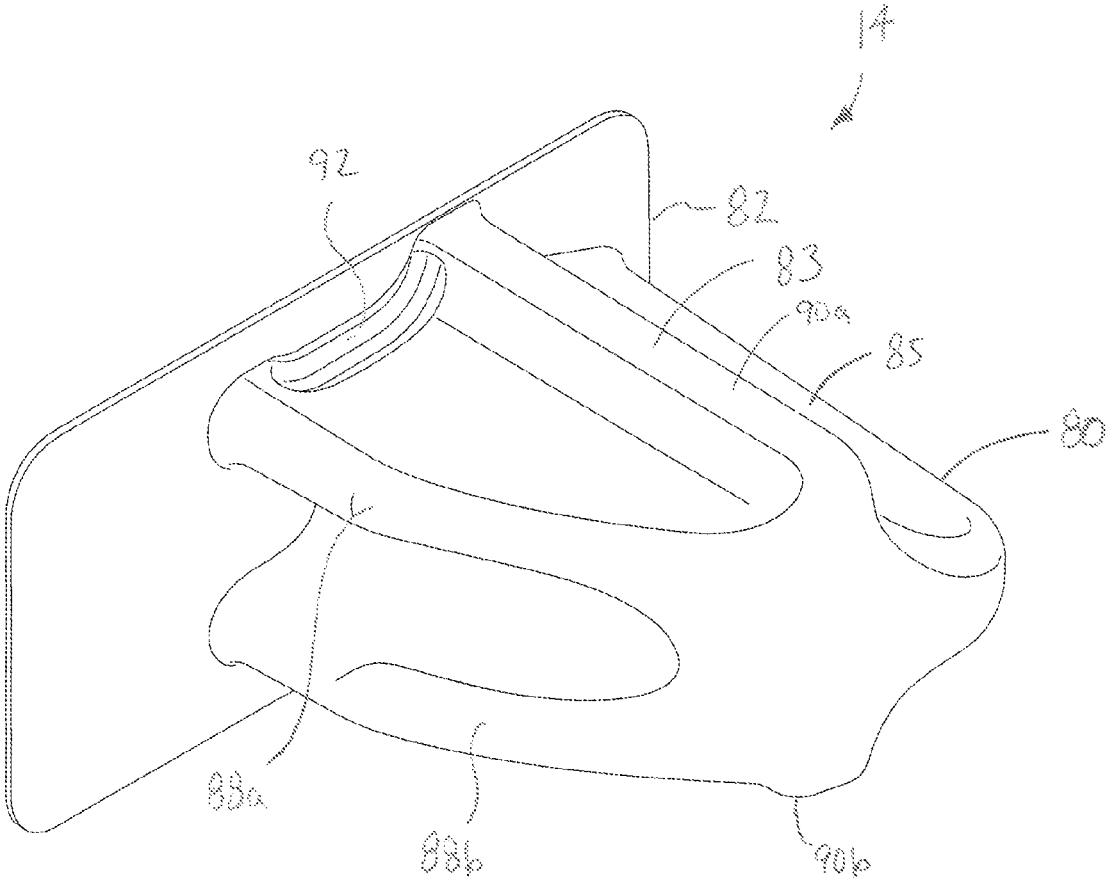
FIG. 5 is a perspective view of an end cap in accordance with one embodiment of the present invention.
Figure 6:
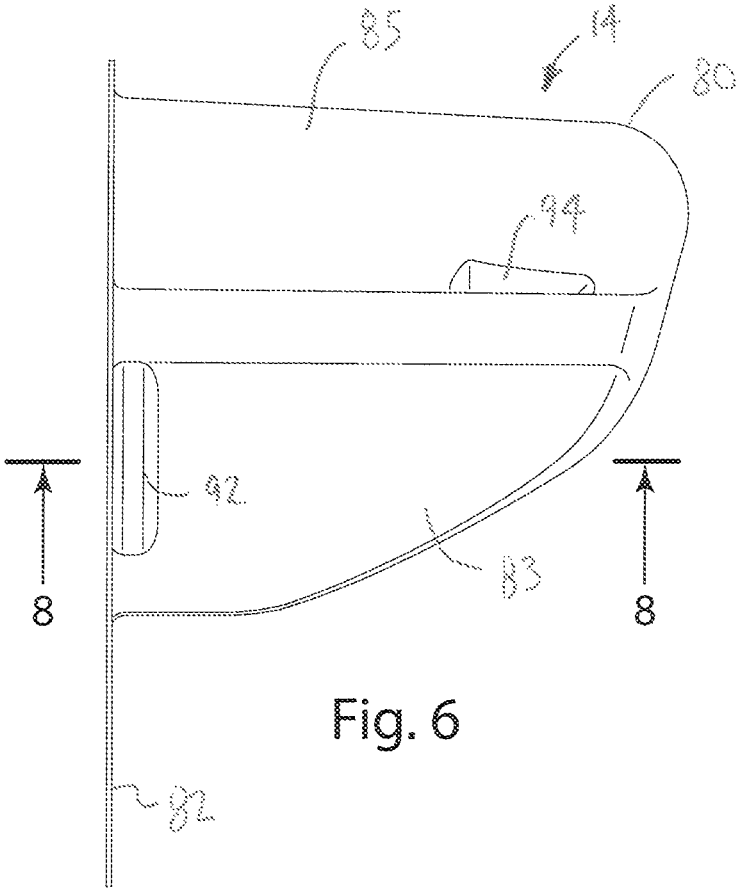
FIG. 6 is a side view of the end cap.
Figure 7:
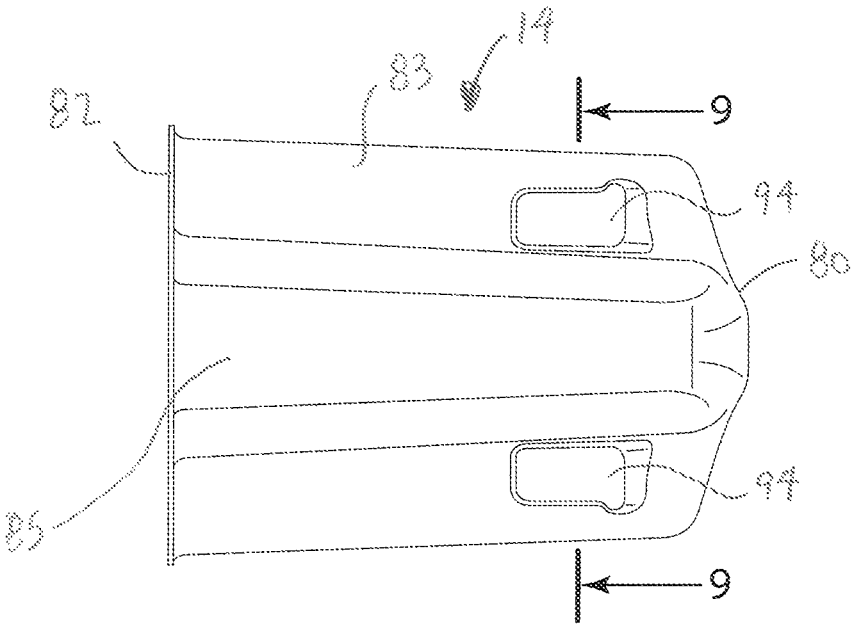
FIG. 7 is a top plan view of the end cap.

As noted above, the package assembly 10 also includes a pair of end caps 14 and 16. In this embodiment, the end caps 14 and 16 are essentially identical to one another. Accordingly, only end cap 14 will be described in detail. In other applications, the package assembly 10 may include different end caps for opposite ends of the wiper blade. For example, when the wiper blade is not symmetrical, it may be desirable to use two different end caps that are specially configured to be fitted onto the differently shaped opposite ends of the wiper blade. In the embodiment of FIGS. 5-7, a single end cap is configured for use on opposite ends of a non-symmetrical wiper blade.

Referring now to FIGS. 5-9, the end cap 14 generally includes a wiper seat 80 and a flange 82. The wiper seat 80 may vary from application to application, but in this embodiment includes a support portion 83 and a tip portion 85. The support portion 83 of this embodiment is configured to closely receive the support element of the wiper blade. In this embodiment, the wiper blade is a beam-type blade having a horizontal portion and an upright portion. The wiper blade of this embodiment is asymmetrical, with the upright portion offset from the center of the blade. The support portion 83 includes a pair of opposed slots 90*a* and 90*b* configured to receive the horizontal portion of the support element. More specifically, the opposed slots 90*a* and 90*b* may be sized and shaped to closely receive the horizontal portion of the support element. The support portion also includes a pair of upright slots 88*a* and 88*b* configured to receive the upright portion of the wiper blade. In this embodiment, the upright portion of the support element is offset from the centerline of the wiper blade. As a result, the support portion includes two different upright slots 88*a* and 88*b*. One of the upright slots 88*a* is configured to receive the upright portion when fitted onto one end of the wiper blade and the other upright slot 88*b* is configured to receive the upright portion when fitted onto the opposite end of the wiper blade. The upright slots 88*a* and 88*b* are sized and shaped to closely receive the upright portion. In this embodiment, the various slots 88*a*, 88*b*, 90*a* and 90*b* cooperate to firmly hold the wiper blade.

The tip portion 85 of the end cap 14 is configured to receive the tip T of the wiper blade W. To avoid affecting the performance of the wiper blade W, the tip portion 85 of the illustrated embodiment is configured so that it does not deform the wiper tip T. More specifically, the tip portion 85 of this embodiment includes a tip slot 86 that forms a void of sufficient size to receive the wiper tip without any contact between the wiper tip and the walls of the tip slot 86. Alternatively, it may be desirable in some application to have the tip slot closely follow the contours of the wiper tip. For example, the tip slot 86 may correspond with the shape of the tip slot such that the wiper tip is in contact with the walls of the tip slot. Although it is desirable not to deform the wiper tip in typical applications, there may be application where that is not a concern. In such applications, it is possible to configure the tip portion to allow it to deform the wiper tip.

Figure 8:
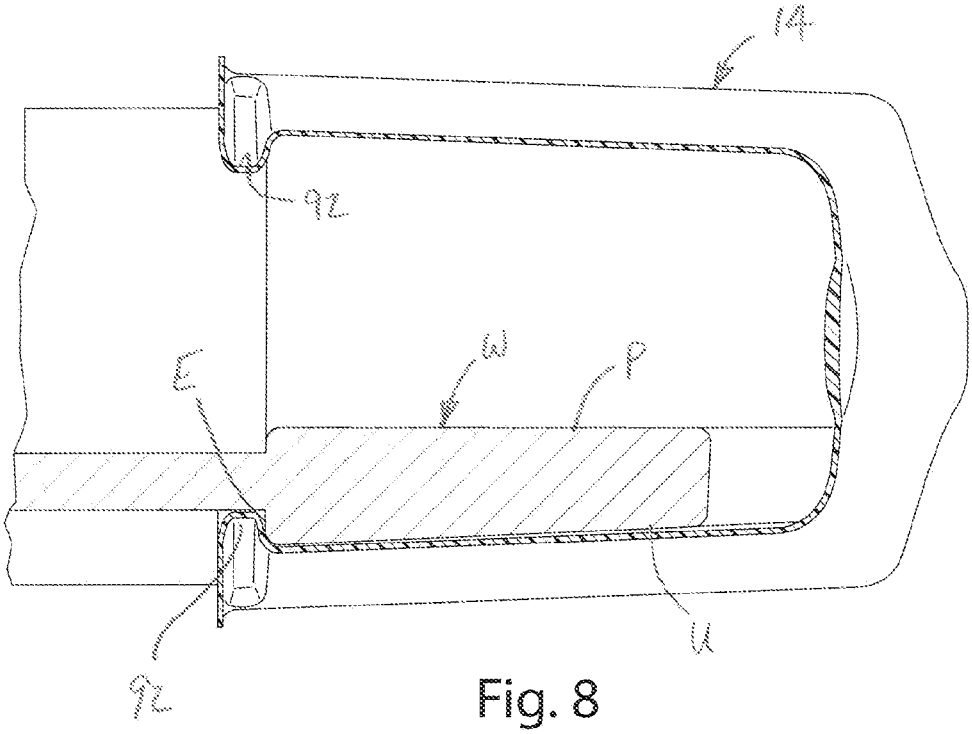
FIG. 8 is a sectional view of the end cap taken along line 8-8 of FIG. 6 showing the protrusion in the end cap snap-locked onto the wiper blade.
Figure 9:
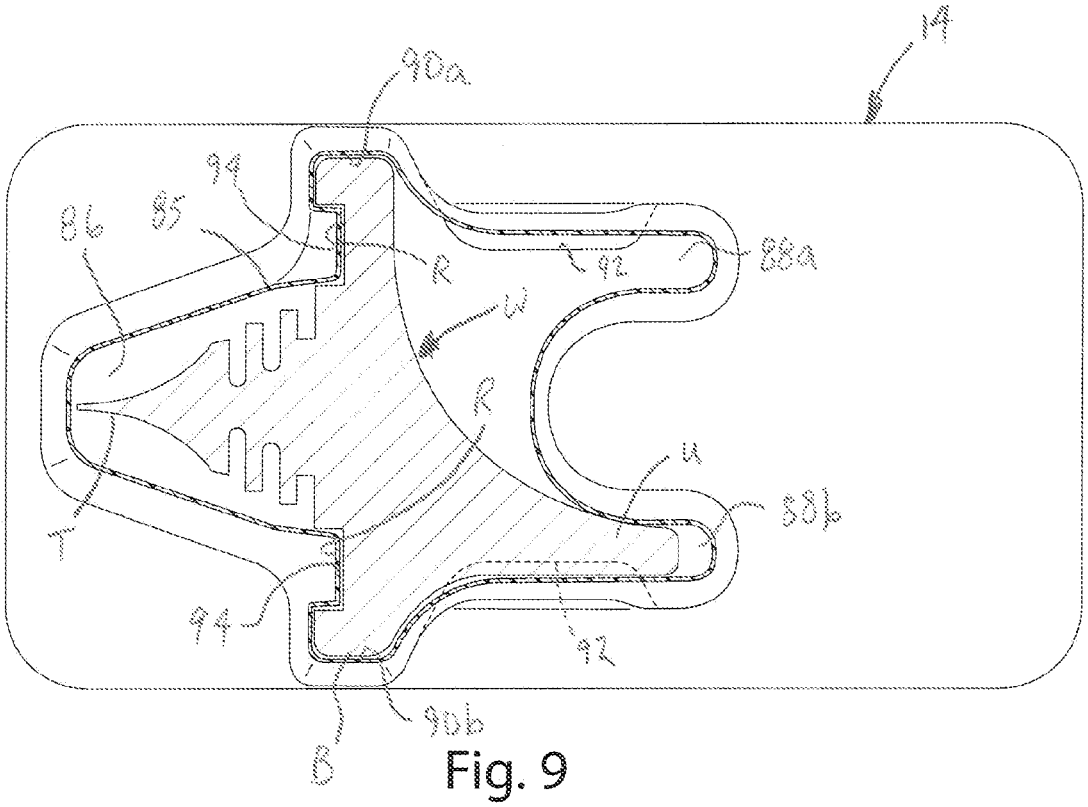
FIG. 9 is a sectional view of the end cap taken along line 9-9 of FIG. 7 showing the wiper blade positioned in the end cap.

In the illustrated embodiment, the end cap 14 is configured to remain in place on the wiper blade once installed. For example, in the illustrated embodiment, the end cap 14 is configured to frictionally fit onto the support element. The friction fit may help to hold the end cap 14 on the wiper blade. Further, the end cap 14 of this embodiment is configured to be snap-fitted onto the wiper blade. In this embodiment, the end cap 14 includes a plurality of indentations that interact with contours in the surface of the wiper blade to snap-lock the end cap 14 onto the wiper blade. More specifically, in this embodiment, the end cap 14 includes first indentations 92 and second indentations 94 that engage contours on the enlarged end piece P of the wiper blade W when the end cap 14 is fitted into the end of the wiper blade W. For example, as shown in FIG. 8, one of the first indentations 92 is configured to snap-fit over the end wall E of the enlarged end piece P of the wiper blade W when on one end of the wiper blade W. Although not specifically shown, the other first indentation 92 is configured to snap-fit over the end wall E of the enlarge end piece P of the wiper blade W when the end cap is on the opposite end of the wiper blade W. Further, as shown in FIG. 9, the second indentations 94 are configured to snap-fit into corresponding recesses R in the beam B of the wiper blade W. In this embodiment, both second indentations 94 engage the recesses R regardless of which end of the wiper blade W the end cap 14 is mounted.

Figure 10:
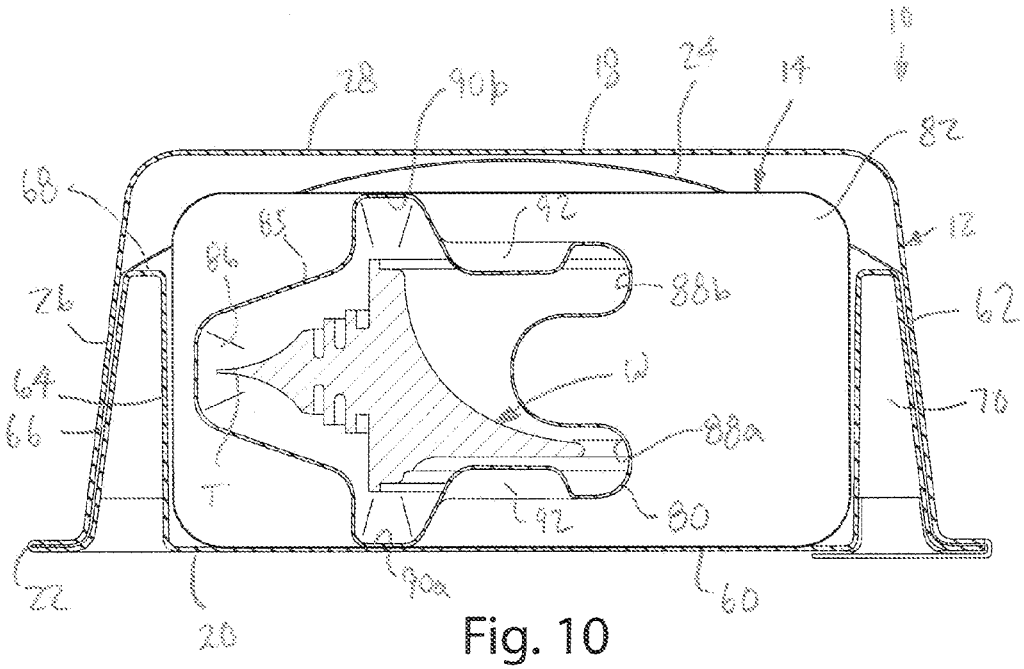
FIG. 10 is a sectional view closed package taken along line 10-10 of FIG. 1 showing the wiper blade within the end cap.

As noted above, the flange 82 may be configured to be fitted closely into the interior of the package 12. For example, in the illustrated embodiment, the flange 82 is generally rectangular and corresponds with the cross-sectional shape of the interior of the package 12. This is perhaps best shown in FIGS. 10 and 11. As a result of the corresponding cross-sectional shape, the flange 82 interacts with the walls of the package 12 to hold the end caps 14 and 16 (and consequently opposite ends of the wiper blade W) in a substantially fixed position within the package 12.

In use, the end caps are fitted onto opposite ends of the wiper blade, and the assembly of wiper blade and end caps are placed into the package. In the illustrated embodiment, the package and end caps are configured to hold a pre-curved wiper blade in an at least partially straighten condition. More specifically, in this embodiment, the wiper blade W is straightened as it is fitted into the package 12 by interaction at three points. The end caps 14 and 16 hold the opposite ends of the wiper blade W in fixed positions with respect to the package 12, and the center C of the wiper blade W engages the side wall of the package, typically requiring the center of the wiper blade to be pushed in an inwardly direction against the pre-curve.

As noted above, a separate end cap 14 and 16 is fitted onto each end of the wiper blade W. In this embodiment, the end caps 14 and 16 are ambidextrous so that different end caps are not required for opposite ends of the wiper blade W. In this embodiment, the wiper blade W includes end pieces P disposed on opposite ends. The end pieces P are enlarged and terminate in an inwardly facing end wall E. Each end piece P include a beam portion B and an upright portion U. The illustrated wiper blade W is asymmetrical in the that upright portion U is offset from the center of the wiper blade W.

In this embodiment, the end caps 14 and 16 are configured to be snap-fitted onto the wiper blade W, which helps them to remain in place on the wiper blade during packaging. As an end cap 14 or 16 is fitted over the end piece P of the wiper blade W, the first indentations 92 and the second indentations 94 eventually snap-lock into engagement with contours in the wiper blade. As noted above and shown in FIG. 8, the first indentations 92 may interface with the end wall E of an end piece P mounted to the end of the wiper blade W. Also as note above, the second indentations 94 may interfit with corresponding recesses R in the end piece P, as shown in FIG. 9. The indentations 92 may be replaced with other contours that help to hold the end caps on the wiper blades. Alternatively, the end caps may be configured to fit onto the wiper blade without any interlocking elements.

The end caps 14 and 16 of this embodiment are configured to function with wiper blade W, as described above. The end caps may, however, vary from application to application to accommodate different wiper blades and different packages 12. For example, the end caps may be provided with an alternative wiper seat 80 to correspond with the shape of a different wiper blade. As another example, the flange 82 may vary to fit within an alternatively shaped package.

The package 12 and end caps 14, 16 may be thermoformed, and may be constructed from polyvinyl chloride (PVC) or polyethylene terephthalate (PET, PETE) or some other formable polymer. Although the material is typically transparent, translucent or clear, the stock may also be opaque, clouded or tinted any suitable color in some applications. The thickness of the material may vary from application to application. For standard applications, the package 12 and end caps 14, 16 are likely to have a thickness ranging between 12 and 30 gauge (i.e., 12 to 30 thousands of an inch). The package 12 and end caps 14, 16 may have the same thickness, or they may vary in thickness, as desired.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular. This disclosure is presented for illustrative purposes and should not be interpreted as an exhaustive description of all embodiments of the invention or to limit the scope of the invention to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features and/or elements and that might individually or cooperatively provide a collection of benefits. The present invention is not limited to only those embodiments that include all of these features and/or elements or that provide all of the stated benefits. Instead, the present invention may extend to any permutation, combination or subcombination of the disclosed features and/or elements.

The embodiments of the invention in which an exclusive property or privilege is claimed are defined as follows:

1. A package assembly comprising:

a wiper blade;

a package having first and second parts cooperatively defining a wiper blade containing space, said wiper blade being fitted into said space;

a first end cap separable from the package fitted onto a first end of said wiper blade; and a second end cap separable from the package fitted onto a second end of said wiper blade, said first end cap and said second end cap disposed within said package, said first end cap and said second end cap cooperating with said package to at least partially straighten said wiper blade.

2. The package assembly of claim 1 wherein said first part and said second part are joined to one another along a living hinge.

3. The package assembly of claim 2 wherein said package include a plurality of interlocking protrusions for securing said first part and said part in a closed position.

4. The package assembly of claim 1 wherein at least one of said first end cap and said second end cap includes a flange closely fitted within said package.

5. The package assembly of claim 4 wherein at least one of said first end cap and said second end cap includes a closed end.

6. The package assembly of claim 5 wherein at least one of said first end cap and said second end cap includes a beam slot to closely receive a portion of a beam of the wiper blade.

7. The package assembly of claim 6 wherein at least one of said first end cap and said second end cap includes a tip slot, said tip slot containing a tip of said wiper blade, said tip slot being shaped so that the tip is not deformed while said wiper blade is packaged.

8. The package assembly of claim 1 wherein said first part includes a base and a peripheral wall extending from a periphery of said base, said first part peripheral wall including a pair of spaced-apart wall segments, said second part including a cover and a peripheral wall extending from a periphery of said cover, said second part peripheral wall fitted over said first part peripheral wall, said second part including at least one locking tab fitted between said spaced-apart wall segments.

9. The package assembly of claim 8 wherein said locking tab includes a finger configured to be closely fitted between said spaced-apart wall segments, said finger and at least one of said spaced-apart wall segments including interfitting contours to secure said finger in position between said spaced-apart wall segments.

10. The package assembly of claim 9 wherein said first part includes at least one pair of transverse wall segments bridging said spaced-apart wall segments to define a receptacle closely receiving said finger.

11. The package assembly of claim 10 wherein said cover of said second part is curved, said cover including at least two nesting elements, each of said nesting elements including a generally flat engagement surface.

12. The package assembly of claim 1 wherein said first end cap and said second end cap are generally identical and are configured to be fitted into opposite ends of said wiper blade, said wiper blade being an asymmetrical wiper blade having a beam with a first portion and an offset second portion, said first end cap and said second end cap each including a beam slot configured to closely receive the first portion of a beam of said wiper blade and a pair of offset support slots configured to alternatively receive the offset second portion depending on which end of said wiper blade said first end cap and said second end cap is fitted.

13. The package assembly of claim 1 wherein each of said first end cap and said second end cap includes a closed end, each of said first end cap and said second end cap includes a beam slot to closely receive a portion of a beam of said wiper blade, each of said first end cap and said second end cap includes a tip slot, said tip slot containing a tip of said wiper blade, said tip slot being shaped so that the tip is not deformed while said wiper blade is packaged, each of said first end cap and said second end cap includes an interlocking element for snap-locking each of said first end cap and said second end cap onto opposite ends of said wiper blade.

14. A package assembly comprising:

a pre-curved wiper blade;

an outer package having front and rear parts cooperatively defining a wiper blade containing space, said front part having a cover and a front peripheral wall, said rear part having a back and a rear peripheral wall;

a first end cap separable from said outer package having a wiper seat and a flange, said wiper seat defining a longitudinally-facing opening fitted over an end of said wiper blade, said flange extending transversely from said wiper seat to engage at least one of said front part and said rear part; and a second end cap separable from said outer package having a wiper seat and a flange, said wiper seat defining a longitudinally-facing opening fitted over an end of said wiper blade, said flange extending transversely from said wiper seat to engage at least one of said front part and said rear part;

wherein said first end cap, said second end cap and said outer package are configured to cooperatively hold said wiper blade in an at least partially straightened configuration.

15. The package assembly of claim 14 wherein said first and second end caps hold opposite ends of said wiper blade in fixed positions with a central portion of said wiper blade engaging said outer package to at least partially straighten the wiper blade.

16. The package assembly of claim 15 wherein said first end cap and said second end cap each includes a beam slot closely receiving a portion of a beam of said wiper blade.

17. The package assembly of claim 16 wherein said first end cap and said second end cap each includes a tip slot, said tip slot containing a tip of said wiper blade, said tip slot being shaped so that the tip is not deformed while said wiper blade is packaged.

18. The package assembly of claim 14 wherein said rear part peripheral wall includes a pair of spaced-apart wall segments, said front part peripheral wall fitted over said rear part peripheral wall, said front part including at least one locking tab capable of being selectively fitted between said spaced-apart wall segments to secure said outer package in a closed position.

19. The package assembly of claim 18 wherein said rear part includes at least one pair of transverse wall segments bridging said spaced-apart wall segments to define a receptacle; and wherein said locking tab includes a finger configured to be closely fitted into said receptacle, said finger and said receptacle including interfitting contours to secure said finger in said receptacle.

20. The package assembly of claim 14 wherein said first end cap and said second end cap are generally identical and are fitted onto opposite ends of said wiper blade, said wiper blade being an asymmetrical wiper blade having a beam with a first portion and an offset second portion, said first end cap and said second end cap each including a beam slot closely receiving the first portion of a beam of said wiper blade and a pair of offset support slots alternatively receiving the offset second portion depending on which end of said wiper blade said first end cap and said second end cap is fitted.

21. The package assembly of claim 14 wherein each of said first end cap and said second end cap includes a closed end, each of said first end cap and said second end cap includes a beam slot closely receiving a portion of a beam of said wiper blade, each of said first end cap and said second end cap includes a tip slot, said tip slot containing a tip of said wiper blade, said tip slot being shaped so that the tip is not deformed while said wiper blade is packaged, each of said first end cap and said second end cap includes an interlocking element for snap-locking each of said first end cap and said second end cap onto opposite ends of said wiper blade.

22. An end cap for supporting a wiper blade assembly fitted in an outer package comprising:

a wiper blade;

an end cap having a wiper seat, said wiper seat shaped to define a wiper blade opening, said wiper blade opening closely receiving an end of said wiper blade, said wiper blade opening in a first direction; and a flange, said flange extending from said wiper seat in a second direction generally perpendicular to said first direction, said flange configured to engage the outer package; and wherein said wiper seat includes a beam slot and a pair of offset support slots capable of being fitted onto either end of an asymmetrical wiper blade; said beam slot closely receiving a first portion of a beam of said wiper blade regardless of which end of said wiper blade said end cap is fitted, said offset support slots configured to alternatively receive an offset second portion of an asymmetrical wiper blade depending on which end of said wiper blade said end cap is fitted.

23. The assembly of claim 22 wherein said wiper seat includes an interlocking element snap-locking said end cap in place on said wiper blade.

24. A package assembly comprising:

a pre-curved wiper blade;

a package having first and second parts cooperatively defining a wiper blade containing space, said wiper blade being fitted into said space;

a first end cap fitted onto a first end of said wiper blade;

a second end cap fitted onto a second end of said wiper blade, said first end cap and said second end cap disposed within said package, said first end cap and said second end cap cooperating with said package to at least partially straighten said wiper blade; and wherein said first end cap and said second end cap are generally identical and are configured to be fitted into opposite ends of an asymmetrical wiper blade having a beam with a first portion and an offset second portion, said first end cap and said second end cap each including a beam slot configured to closely receive the first portion of a beam of said wiper blade and a pair of offset support slots configured to alternatively receive the offset second portion depending on which end of the wiper blade said first end cap and said second end cap is fitted.

25. A package assembly comprising:

a pre-curved wiper blade;

a package having first and second parts cooperatively defining a wiper blade containing space, said wiper blade being fitted into said space;

a first end cap fitted onto a first end of said wiper blade; and a second end cap fitted onto a second end of said wiper blade, said first end cap and said second end cap disposed within said package, said first end cap and said second end cap cooperating with said package to at least partially straighten said wiper blade;

wherein each of said first end cap and said second end cap includes a closed end, each of said first end cap and said second end cap includes a beam slot closely receiving a portion of a beam of said wiper blade, each of said first end cap and said second end cap includes a tip slot, said tip slot containing a tip of said wiper blade, said tip slot being shaped so that the tip is not deformed while said wiper blade is packaged, each of said first end cap and said second end cap includes an interlocking element snap-locking each of said first end cap and said second end cap onto opposite ends of said wiper blade.

* * * * *

UNITED STATES PATENT AND TRADEMARK OFFICE

CERTIFICATE OF CORRECTION

PATENT NO. : 8,505,724 B2
APPLICATION NO. : 13/585922
DATED : August 13, 2013
INVENTOR(S) : David H. Bult et al.

It is certified that error appears in the above-identified patent and that said Letters Patent is hereby corrected as shown below:

In the Claims:

Column 11, Claim 22, Line 11:
after "opening" insert --opening--

Signed and Sealed this
Twelfth Day of November, 2013

Teresa Stanek Rea
*Deputy Director of the United States Patent and Trademark Office*